US009437162B2

(12) United States Patent
Ikenishi et al.

(10) Patent No.: US 9,437,162 B2
(45) Date of Patent: Sep. 6, 2016

(54) IMAGE OUTPUT APPARATUS, CONTROL METHOD THEREFOR, IMAGE DISPLAY APPARATUS, CONTROL METHOD THEREFOR, AND STORAGE MEDIUM

(71) Applicant: CANON KABUSHIKI KAISHA, Tokyo (JP)

(72) Inventors: Shunsuke Ikenishi, Yokohama (JP); Joji Kamahara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 678 days.

(21) Appl. No.: 13/689,963

(22) Filed: Nov. 30, 2012

(65) Prior Publication Data

US 2013/0155123 A1 Jun. 20, 2013

(30) Foreign Application Priority Data

Dec. 6, 2011 (JP) ..... 2011-267145
Aug. 31, 2012 (JP) ..... 2012-191859

(51) Int. Cl.
*G09G 5/10* (2006.01)
*G09G 3/34* (2006.01)

(52) U.S. Cl.
CPC ..... *G09G 5/10* (2013.01); *G09G 3/342* (2013.01); *G09G 3/3426* (2013.01); *G09G 2320/0646* (2013.01); *G09G 2360/04* (2013.01); *G09G 2380/08* (2013.01)

(58) Field of Classification Search
CPC ..... G09G 5/10; G09G 3/3426; G09G 3/342; G09G 2380/08; G09G 2320/0646; G09G 2360/04
USPC ..... 345/1.1
See application file for complete search history.

(56) References Cited

U.S. PATENT DOCUMENTS 7,460,103 B2 * 12/2008 Konno et al. ..... 345/102
8,228,285 B2 * 7/2012 Inada ..... G09G 3/3426 345/102

(Continued)

FOREIGN PATENT DOCUMENTS

JP 11-065531 3/1999
JP 11-276441 A 10/1999

(Continued)

OTHER PUBLICATIONS

The documents cited herein were cited in the Jun. 7, 2016 Japanese Office Action, of which is enclosed without an English Translation, that issued in Japanese Patent Application No. 2012-191859.

*Primary Examiner* — Kathy Wang-Hurst
*Assistant Examiner* — Joseph Fox
(74) *Attorney, Agent, or Firm* — Cowan, Liebowitz & Latman, P.C.

(57) ABSTRACT

Disclosed is an image output apparatus that outputs a plurality of image data to one or a plurality of image display apparatuses capable of controlling amounts of light of backlights, the image output apparatus including: a determining unit configured to determine whether the plurality of image data satisfy a predetermined condition; and a controlling unit configured to control, when the determining unit determines that the plurality of image data satisfy the predetermined condition, the one or the plurality of image display apparatuses such that either or both of amounts of light and number of light emission control units of the backlights used for display of the plurality of image data are the same.

20 Claims, 13 Drawing Sheets

(56) References Cited

U.S. PATENT DOCUMENTS

| | | | | |
|---|---|---|---|---|
| 8,896,619 | B2 * | 11/2014 | Rezaee | 345/1.1 |
| 2003/0231161 | A1 * | 12/2003 | Yamaguchi | 345/102 |
| 2004/0150649 | A1 * | 8/2004 | Moscovitch | 345/589 |
| 2004/0217918 | A1 * | 11/2004 | Ando | G06F 3/1446 345/1.1 |
| 2007/0120763 | A1 * | 5/2007 | De Paepe et al. | 345/1.3 |
| 2008/0198094 | A1 * | 8/2008 | Laughlin | 345/1.1 |
| 2009/0080719 | A1 * | 3/2009 | Watt | 382/128 |
| 2011/0037784 | A1 * | 2/2011 | Shiomi | 345/690 |
| 2011/0095965 | A1 * | 4/2011 | Yoneoka et al. | 345/1.1 |

FOREIGN PATENT DOCUMENTS

| | | |
|---|---|---|
| JP | 2004-159986 A | 6/2004 |
| JP | 2005-070080 | 3/2005 |

* cited by examiner

WHEN NUMBER OF LIGHT EMISSION CONTROL UNITS OF BACKLIGHTS ARE SAME

・NUMBER OF LIGHT EMISSION CONTROL UNITS OF BACKLIGHTS ARE SAME
・SET AMOUNTS OF LIGHT OF BACKLIGHTS COMMON?

Yes No

*Fig.12A*

WHEN NUMBER OF LIGHT EMISSION CONTROL UNITS OF BACKLIGHTS ARE DIFFERENT

・SET NUMBER OF LIGHT EMISSION CONTROL UNITS OF BACKLIGHTS COMMON?

Yes No

・SET AMOUNTS OF LIGHT OF BACKLIGHTS COMMON?

Yes No

*Fig.12B*

IMAGE OUTPUT APPARATUS, CONTROL METHOD THEREFOR, IMAGE DISPLAY APPARATUS, CONTROL METHOD THEREFOR, AND STORAGE MEDIUM

BACKGROUND OF THE INVENTION

1. Field of the Invention

The present invention relates to an image output apparatus, a control method therefor, an image display apparatus, a control method therefor, and a storage medium.

2. Description of the Related Art

Conventionally, a liquid crystal image display apparatus displays an image by keeping an amount of light of a backlight constant, and controlling a voltage applied to a liquid crystal layer and changing the transmittance of liquid crystal to adjust an amount of light transmitted through the liquid crystal layer. However, there is a limit in reducing the transmittance of the liquid crystal. Therefore, even if the transmittance of the liquid crystal is minimized, in some cases, the light of the backlight is transmitted through the liquid crystal layer and sufficient contrast is not obtained. As a countermeasure against this problem, there is known a technique for improving contrast by performing dimming control for adjusting an amount of light of a backlight according to an image signal.

The dimming control include global dimming for uniformly changing an amount of light of the entire backlight and local dimming for dividing the backlight into several control regions and independently changing an amount of light for each of the divided control regions. In the global dimming control, the number of light emission control units is one. In the local dimming control, the number of light emission control units is two or more.

In the dimming control, for example, for each of the control regions, a peak signal level of image data input to a display region of a liquid crystal panel corresponding to the control region is acquired. An amount of light of the backlight in the control region is adjusted to set the brightness of a display screen at the maximum transmittance of liquid crystal to brightness corresponding to the peak signal level. Again or a lookup table (LUT) is adjusted to set the peak signal level to a maximum signal level (see, for example, Japanese Patent Application Laid-Open No. H11-65531). The peak signal level is a highest signal level among signal levels of all pixels of the image data input to the display region of the liquid crystal panel corresponding to the control region. The LUT is a table in which signal levels to be output corresponding to signal levels to be input are set by an image processing unit of an image display apparatus. The liquid crystal panel is driven on the basis of image data subjected to image processing according to the LUT.

In recent years, a liquid crystal image display apparatus is used for, for example, diagnosis of a modality image in the medical field. The modality image is an image captured by a medical capturing apparatus for digital radiography (DR) or computed tomography (CT). In medical diagnosis, for example, two liquid crystal image display apparatuses are set side by side and caused to respectively display different images and comparative diagnosis is performed. For example, a modality image of a region captured this time is displayed on one image display apparatus and a modality image of the same capturing region and of the same kind captured in the past is displayed on the other image display apparatus. In the diagnosis based on the modality images, it is important that a human observer can recognize a brightness difference between gradations. Therefore, the image display apparatuses that display the modality images are required to have a high contrast characteristic and gradation reproducibility.

There is a technique for, in order to equalize dynamic ranges of a plurality of image display apparatuses having different displayable brightness ranges, setting a highest value among lowest brightnesses of the image display apparatuses as common lowest brightness and setting a lowest value among highest brightnesses of the image display apparatuses as common highest brightness (see, for example, Japanese Patent Application Laid-Open No. 2005-070080).

The dimming control is performed according to image data input to an image display apparatus. Therefore, when different image data are respectively input to a plurality of image display apparatuses, amounts of light of backlights determined by the dimming control could not be the same in the plurality of image display apparatuses. Therefore, in a form of use for causing the plurality of image display apparatuses to display different images and performing comparative diagnosis, amounts of light of the backlights could not be the same in the plurality of image display apparatuses.

Then, gradation reproducibility such as a degree of floating black is different among the image display apparatuses. Therefore, it is likely that accurate image comparison cannot be performed. In an image display apparatus which enables local dimming, this problem could also occur when a screen is divided into a plurality of display regions and different images displayed in different display regions are compared.

SUMMARY OF THE INVENTION

Therefore, the present invention provides a technique for making it possible to accurately perform comparison of images when different images are displayed in a plurality of image display apparatuses or a plurality of display regions for adjusting amounts of light of backlights according to input image data.

According to the present invention, there is provided an image output apparatus that outputs a plurality of image data to one or a plurality of image display apparatuses capable of controlling amounts of light of backlights, the image output apparatus including: a determining unit configured to determine whether the plurality of image data satisfy a predetermined condition; and a controlling unit configured to control, when the determining unit determines that the plurality of image data satisfy the predetermined condition, the one or the plurality of image display apparatuses such that either or both of amounts of light and number of light emission control units of the backlights used for display of the plurality of image data are the same.

According to the present invention, there is provided an image display apparatus capable of controlling an amount of light of a backlight, the image display apparatus including: an acquiring unit configured to acquire information on first image data input to the image display apparatus and second image data input to another image display apparatus; a determining unit configured to determine, on the basis of the information acquired by the acquiring unit, whether the first and second image data satisfy a predetermined condition; and a controlling unit configured to control, when the determining unit determines that the first and second image data satisfy the predetermined condition, the image display apparatus and the other image display apparatus such that either or both of amounts of light and number of light emission control units of backlights used for display of the first and second image data are the same.

According to the present invention, there is provided a control method for an image output apparatus that outputs a plurality of image data to one or a plurality of image display apparatuses capable of controlling amounts of light of backlights, the control method including the steps of: determining whether the plurality of image data satisfy a predetermined condition; and controlling, when it is determined in the determining step that the plurality of image data satisfy the predetermined condition, the one or the plurality of image display apparatuses such that either or both of amounts of light and number of light emission control units of the backlights used for display of the plurality of image data are the same.

According to the present invention, there is provided a control method for an image display apparatus capable of controlling an amount of light of a backlight, the control method including the steps of: acquiring information on first image data input to the image display apparatus and second image data input to another image display apparatus; determining, on the basis of the information acquired in the acquiring step, whether the first and second image data satisfy a predetermined condition; and controlling, when it is determined in the determining step that the first and second image data satisfy the predetermined condition, the image display apparatus and the other image display apparatus such that either or both of amounts of light and number of light emission control units of backlights used for display of the first and second image data are the same.

It is possible to accurately perform comparison of images when different images are displayed in a plurality of image display apparatuses or a plurality of display regions for adjusting amounts of light of backlights according to input image data.

Further features of the present invention will become apparent from the following description of exemplary embodiments with reference to the attached drawings.

BRIEF DESCRIPTION OF THE DRAWINGS

FIG. 7 is a diagram for explaining regions of interest according to a second embodiment.

FIG. 12 is a diagram showing detailed inquiry screen example according to the fourth embodiment, wherein FIG. 12A shows a detailed inquiry screen example displayed when number of light emission control units are the same and FIG. 12B shows a detailed inquiry screen example displayed when number of light emission control units are different.

DESCRIPTION OF THE EMBODIMENTS

First Embodiment

Embodiments of the present invention are explained below with reference to the accompanying drawings. However, the embodiments are not intended to limit the scope of the present invention. The present invention can be carried out in various forms within the scope.

Figure 1:
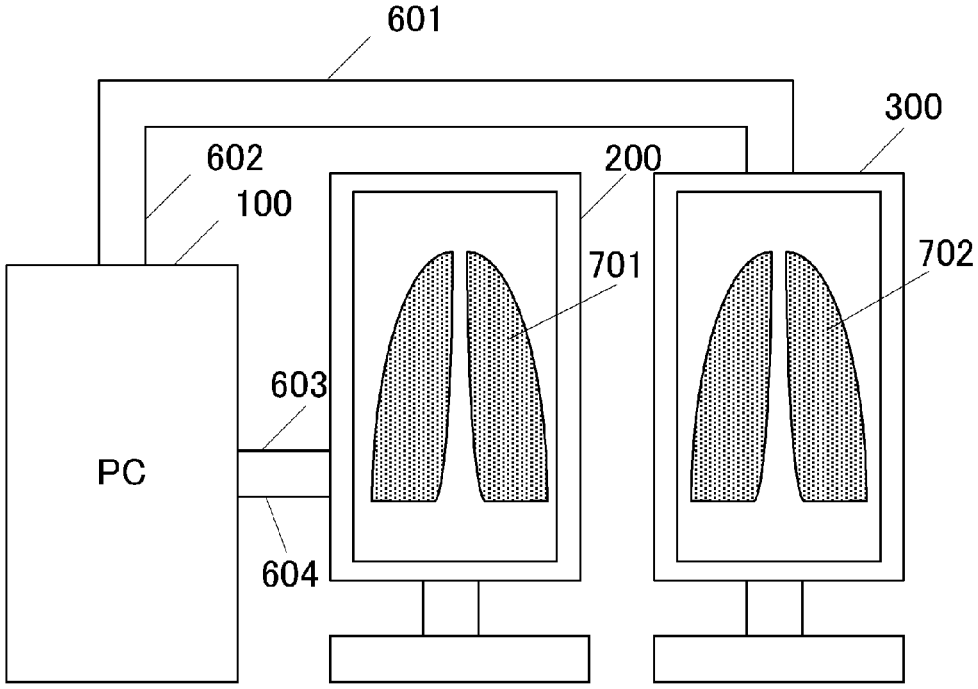
FIG. 1 is a schematic configuration diagram of an image display system according to a first embodiment.

FIG. 1 is a schematic configuration diagram of an image display system including an image output apparatus and image display apparatuses according to a first embodiment. As an image output apparatus 100 shown in FIG. 1, a general-purpose personal computer (PC) can be used. The PC 100 outputs image data to an image display apparatus 300 via a display port (DP) cable 601 and outputs image data to an image display apparatus 200 via a DP cable 603. The PC 100 can output different image data respectively to the image display apparatus 200 and the image display apparatus 300 (multi-monitor display). In an example shown in FIG. 1, an image 701 displayed on the image display apparatus 200 is a latest DR image of the lung of a patient A. An image 702 displayed on the image display apparatus 300 is a DR image of the lung of the patient A captured (photographed) one year ago. The image 701 and the image 702 are respectively displayed on the image display apparatus 200 and the image display apparatus 300 in full screens. The image 701 and the image 702 are examples of different image data of the same capturing region and of the same modality type. The PC 100 may be capable of outputting the same image data to the two image display apparatuses. The modality indicates a medical equipment classification. Examples of the modality include magnetic resonance imaging (MRI), ultrasonic capturing, and mammography besides DR and CT.

The PC 100 and the image display apparatus 200 are connected by a universal serial bus (USB) cable 604 and the PC 100 and the image display apparatus 300 are connected by a USB cable 602 to be capable of transmitting and receiving commands. The image display apparatus 200 and the image display apparatus 300 are liquid crystal displays that include backlights and liquid crystal panels and perform dimming control for adjusting amounts of light of the backlights according to input image data. The image display apparatuses 200 and 300 can execute, as the dimming control, global dimming control for uniformly adjusting an amount of light of an entire backlight and local dimming control for dividing the backlight into a plurality of control regions and independently adjusting an amount of light for each of the control regions. Output of image data to the image display apparatus 200 and the image display apparatus 300 is controlled by a medical image viewer, which is a computer program running on the PC 100.

Image processing performed in the image display apparatus 200 and image processing performed in the image display apparatus 300 are set the same. As the setting of the image processing, there are, for example, white brightness, black brightness, and a γ curve. As the γ curve, digital imaging and communication in medicine grayscale standard display function (DICOM GSDF), a γ value 1.8, a γ value 2.2, and the like can be set.

Figure 2:
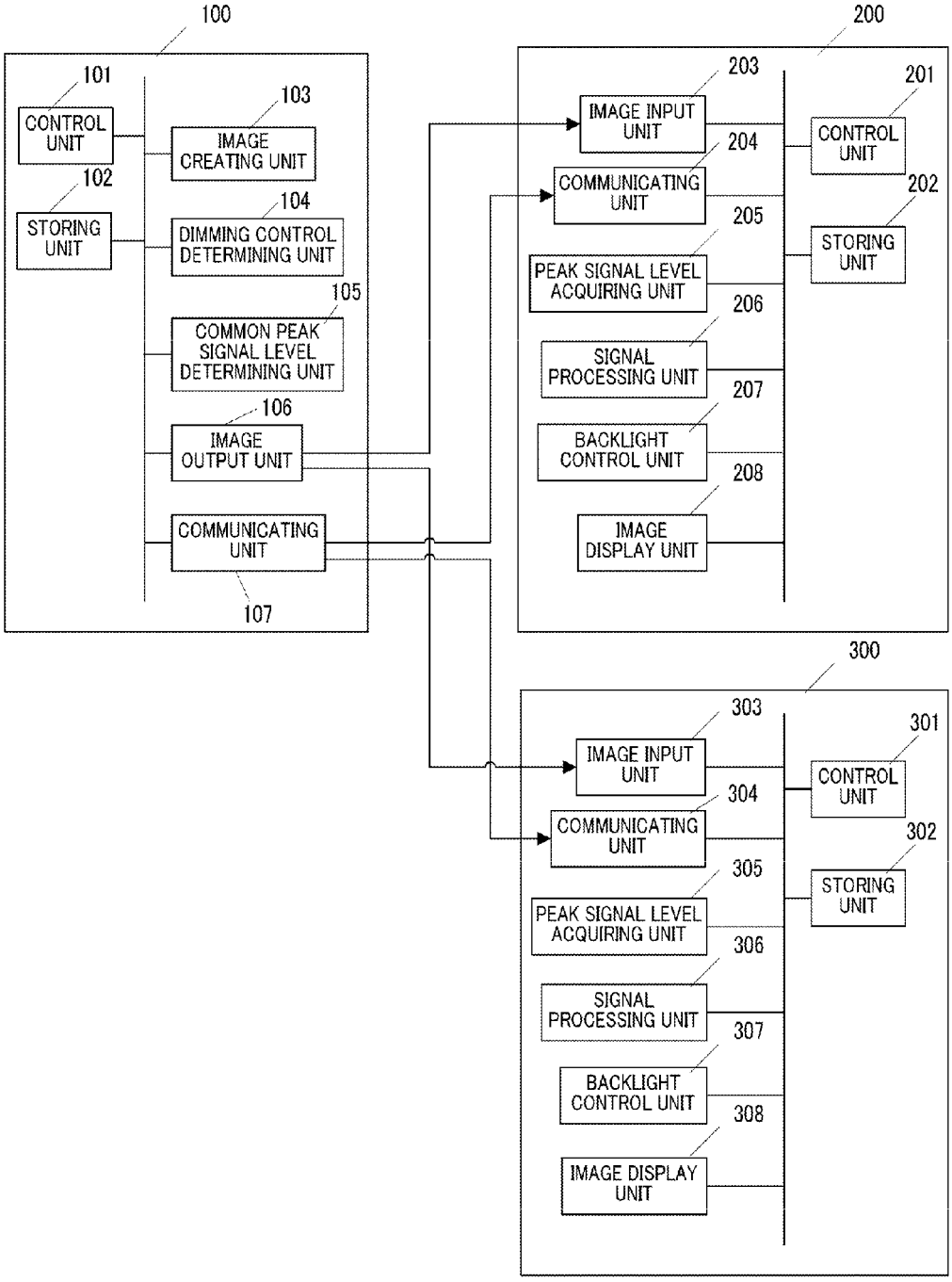
FIG. 2 is a functional block diagram of the image display system according to the first embodiment.

FIG. 2 is a functional block diagram of the PC 100, the image display apparatus 200, and the image display apparatus 300 shown in FIG. 1.

Functional blocks of the PC 100 are explained.

A control unit 101 is, for example, a central processing unit (CPU). The control unit 101 controls the entire PC 100 on the basis of a computer program stored in a storing unit 102.

An image creating unit 103 creates image data to be output to the image display apparatus 200 and the image display apparatus 300. The image creating unit 103 generates image data by, for example, decoding encoded data.

A dimming control determining unit 104 determines whether common dimming control should be performed in the image display apparatus 200 and the image display apparatus 300. "Performing the common dimming control" means that an amount of light of the backlights determined by the dimming control is common in the image display apparatus 200 and the image display apparatus 300. Specifically, when the common dimming control is performed, even if image data input to the image display apparatus 200 and image data input to the image display apparatus 300 are different, amounts of light of the backlights thereof are equally controlled. The dimming control determining unit 104 determines whether the image data created by the image creating unit 103 are image data of the same modality and whether the image data is image data of the same capturing region. According to a result of the determination, the dimming control determining unit 104 determines whether the common dimming control is performed. The capturing region is a portion of a body to be captured in a modality image. In the example shown in FIG. 1, the capturing region is the lung and the modality is DR. A method of determining the modality and the capturing region of image data is explained below.

When amounts of light of the backlight are controlled to be common in the image display apparatus 200 and the image display apparatus 300, number of light emission control units of the backlights are inevitably common. Specifically, both of the image display apparatus 200 and the image display apparatus 300 are subjected to the global dimming control in common or subjected to the local dimming control in common. When both of the image display apparatus 200 and the image display apparatus 300 are subjected to the local dimming control in common, the number of light emission control units of the backlights are set equal.

When the dimming control determining unit 104 determines that the common dimming control should be performed, a common peak signal level determining unit 105 acquires peak signal levels from the two image data to be output to the image display apparatuses 200 and 300 created by the image creating unit 103. The common peak signal level determining unit 105 determines a common peak signal level. The common peak signal level is a higher signal level of the respective peak signal levels of the two image data. The peak signal level is a highest signal level (e.g., a maximum brightness signal level) among signal levels of all pixels of image data. An average of the respective peak signal levels of the two image data may be set as the common peak signal level.

An image output unit 106 outputs the image data created by the image creating unit 103 to each of the image display apparatus 200 and the image display apparatus 300.

A communicating unit 107 transmits information on the common peak signal level determined by the common peak signal level determining unit 105 to each of the image display apparatus 200 and the image display apparatus 300 as information for determining light amount control for the backlights.

The image display apparatus 200 is explained. Since the image display apparatus 300 has the same configuration as the image display apparatus 200, explanation of the image display apparatus 300 is omitted.

A control unit 201 is, for example, a central processing unit (CPU). The control unit 201 controls the entire image display apparatus 200 on the basis of a computer program stored in a storing unit 202.

An image input unit 203 receives image data output from the PC 100.

A peak signal level acquiring unit 205 acquires a peak signal level of the image data input to the image input unit 203.

A signal processing unit 206 adjusts an LUT (lookup table) on the basis of the peak signal level and applies image processing to the image data input to the image input unit 203.

A backlight control unit 207 adjusts an amount of light of the backlight on the basis of the peak signal level.

The adjustment of the LUT and the adjustment of an amount of light of the backlight performed by the signal processing unit 206 and the backlight control unit 207 on the basis of the peak signal level are included in the dimming control performed by the image display apparatus 200.

The control unit 201 determines which of a peak signal level acquired from the peak signal level acquiring unit 205 and a common peak signal level transmitted from the PC 100 is used as a peak signal level on which the dimming control is based. When the image display apparatuses 200 and 300 respectively perform the dimming control on the basis of peak signal levels acquired by peak signal level acquiring units 205 and 305, the dimming control is independently performed in the two image display apparatuses. When both the image display apparatuses 200 and 300 perform the dimming control on the basis of the common peak signal level transmitted from the PC 100, common dimming control is performed in the two image display apparatuses.

Figure 3:
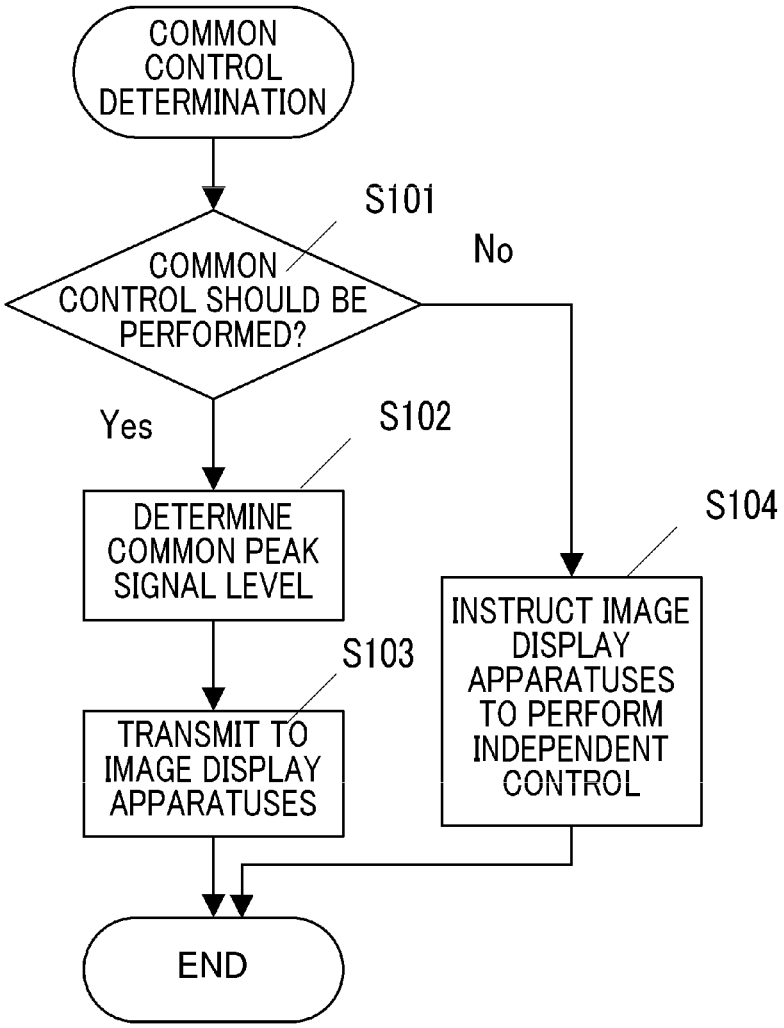
FIG. 3 is a flowchart for explaining the operation of a PC according to the first embodiment.

The operation of the PC 100 is explained according to a flowchart of FIG. 3. Processing indicated by the flowchart is started when the medical image viewer running on the PC 100 displays new image data or when the medical image viewer changes displayed image data. In this embodiment, it is assumed that image data is medical image data distinguished by a modality and a capturing region.

In S101, the dimming control determining unit 104 determines whether the common dimming control is performed in the image display apparatus 200 and the image display apparatus 300. When two input image data respectively output to the image display apparatus 200 and the image display apparatus 300 are image data of the same modality and of the same capturing region, the dimming control determining unit 104 determines that the common dimming control is performed in the image display apparatus 200 and the image display apparatus 300.

Examples of a method of determining whether the modalities and the capturing regions of the two image data are the same include a method of performing the determination on the basis of header information of the image data and a method of performing the determination by analyzing the image data using publicly-known matching processing or the like. Image data conforming to the DICOM standard includes meta-information, a data element, and image information. In the data element, elements including a tag, value representations (VR), Value Length, and Value Field are arrayed in order. The tag is represented by a combination of a group number and an element number of hexadecimal numbers such as (0010, 0020). For example, (0010, 0010) represents a name of a patient, (0018, 0015) represents a capturing region, and (0008, 0060) represents a modality. It is possible to acquire information on the capturing region of the image data by referring to a field value of the data element of the tag (0018, 0015). It is possible to acquire information on the modality of the image data by referring to a field value of the data element of the tag (0008, 0060). The VR indicates, as value representation, a data format such as a numerical value, a character string, and time included in the Value Field. The Value Length indicates, as bytes, the length of a value of the Value Field. The Value Field indicates a region of the value. When the image data is data of the DICOM standard, the dimming control determining unit 104 can determine, by referring to a value of the Value Field of the data element affixed with the tags of the capturing region and the modality, whether the modalities and the capturing regions of the two image data are the same.

In an example explained in this embodiment, when the modalities and the capturing regions of the two image data are the same, it is determined that the common dimming control is performed in the image display apparatus 200 and the image display apparatus 300. However, a condition for determining that the common dimming control is not limited to this. It can be arbitrarily set what kind of condition should be satisfied to determine that the common dimming control is performed. For example, the common dimming control may be performed when patient names, modalities, and capturing regions are the same. The common dimming control may be performed when one or more of patient names, modalities, and capturing regions are the same. Meta-information on a modality and a capturing region is not always added to image data. Therefore, even when only one of patient names, modalities, and capturing regions are the same, it is sometimes desirable to perform the common dimming control. Meta-information indicating capturing time may be taken into account to determine whether the common dimming control is performed. For example, when capturing times of two image data are different and at least any of patient names, modalities, and capturing regions of the image data are the same, the common dimming control may be performed.

When it is not determined in S101 that the common dimming control should be performed (No in S101), the processing proceeds to S104.

In S104, the communicating unit 107 notifies the image display apparatus 200 and the image display apparatus 300 that the dimming control should be independently performed in the image display apparatus 200 and the image display apparatus 300. The processing of the flowchart ends.

When it is determined in S101 that the common dimming control should be performed (Yes in S101), the processing proceeds to S102. In S102, the common peak signal level determining unit 105 is first acquiring means for acquiring a peak signal level from the image data displayed on the image display apparatus 200 and the image data displayed on the image display apparatus 300. The common peak signal level determining unit 105 determines a common peak signal level.

In S103, the communicating unit 107 transmits information on the common peak signal level determined in S102 to the image display apparatus 200 and the image display apparatus 300.

Figure 4:
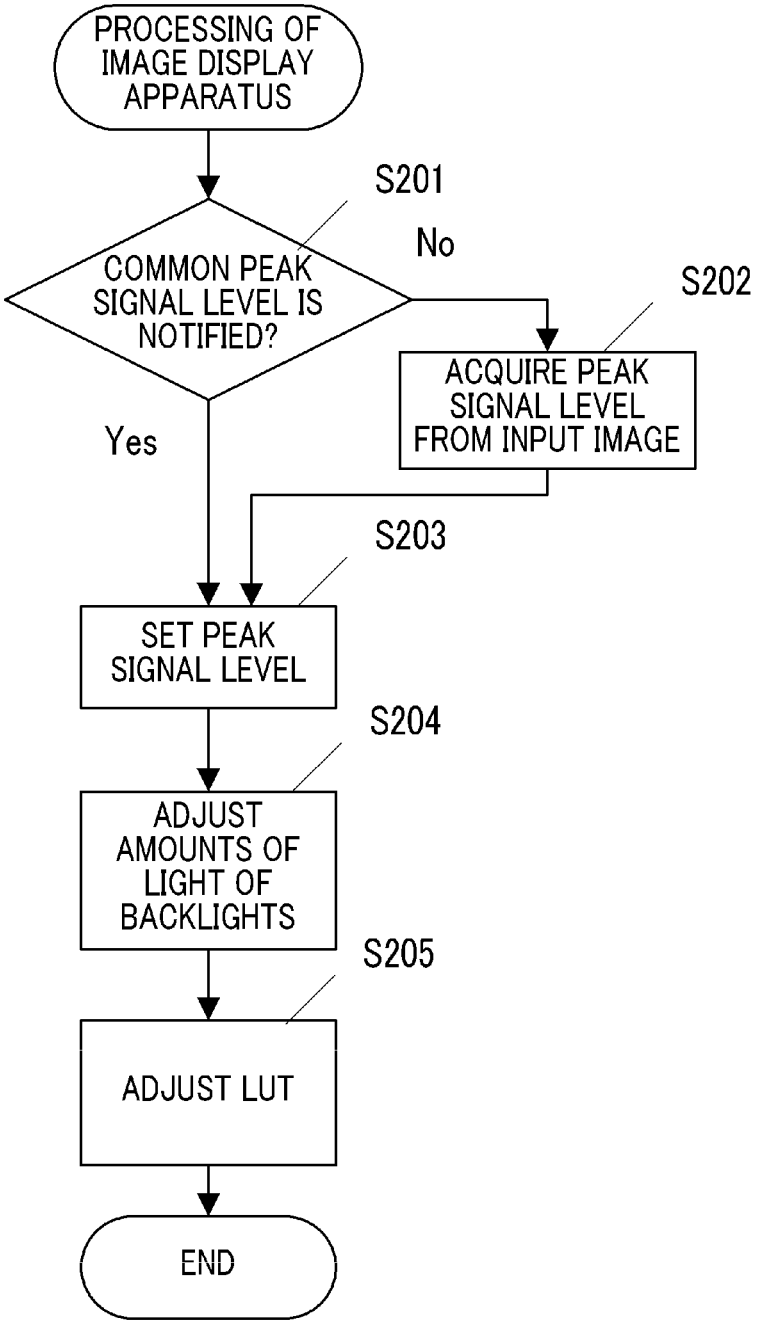
FIG. 4 is a flowchart for explaining the operation of an image display apparatus according to the first embodiment.

The operations of the image display apparatus 200 and the image display apparatus 300 are explained according to a flowchart of FIG. 4. In the explanation, the operation of the image display apparatus 200 is explained using the reference signs of the image display apparatus 200. However, the same operation is performed in the image display apparatus 300. Processing of the flowchart is started in synchronization with a vertical synchronization signal of image data input to the image input unit 203 of the image display apparatus 200.

In S201, the control unit 201 checks whether information on a common peak signal level is notified from the PC 100. When a common peak signal level is notified, the common peak signal level is effective until it is notified from the PC 100 that the common dimming control is not performed.

When it is determined in S201 that information on a common peak signal level is notified (Yes in S201), the processing proceeds to S203. The control unit 201 sets the notified common peak signal level as a peak signal level used for the dimming control.

When it is determined in S201 that information on a common peak signal level is not notified (No in S201), the processing proceeds to S202. The peak signal level acquiring unit 205 acquires a peak signal level from image data input to the image input unit 203. In S203, the control unit 201 sets the acquired peak signal level as a peak signal level used for the dimming control.

In S204, the backlight control unit 207 adjusts an amount of light of the backlight according to the peak signal level set in S203. At this point, the backlight control unit 207 adjusts the amount of light of the backlight to set the brightness of a screen surface at the time when the liquid crystal panel has transmittance corresponding to the peak signal level to the brightness of the screen surface at the time of a signal level maximum value (in the case of 8 bits, 255).

In S205, the signal processing unit 206 adjusts the LUT on the basis of the peak signal level set in S203. In the adjustment of the LUT, the signal processing unit 206 sets an output value of the LUT corresponding to the input of the peak signal level as a maximum value of a signal level and sets an output value of the LUT corresponding to the input of a signal level 0 to 0. The signal processing unit 206 sets an output value of the LUT corresponding to the input of other signal levels n to a value $n \times \gamma$. A method of calculating output values of the LUT corresponding to input signal levels when the setting of the $\gamma$ curve is DICOM. GSDF is as explained below. First, the signal processing unit 206 calculates a white brightness value and a black brightness value on the basis of an amount of light of the backlight changed by the adjustment in S204 and a white brightness value and a black brightness value before the adjustment. The signal processing unit 206 calculates a value of the LUT corresponding to the signal level n according to the following expression:

(target brightness value of the signal level $n$/target brightness value corresponding to the peak signal level)×maximum signal level.

When the PC 100 determines that the common dimming control should be performed in the image display apparatus 200 and the image display apparatus 300 as explained above, the common dimming control based on the common peak signal level is performed in both of the image display apparatus 200 and the image display apparatus 300. Even when different image data are displayed on a plurality of image display apparatuses, the image data are displayed on the image display apparatus in a state in which degrees of floating black and gradation reproducibilities are adjusted to be the same. Therefore, it is possible to accurately perform diagnosis based on a comparison of images.

In the explanation of this embodiment, the common dimming control performed in the image display apparatus 200 and the image display apparatus 300 during the comparative diagnosis. The dimming control may be either the global dimming control or the local dimming control as explained above. However, even if the image display apparatus 200 and the image display apparatus 300 can perform the local dimming control, the image display apparatus 200 and the image display apparatus 300 may be adapted not to perform the local dimming control when the two image display apparatuses are caused to display different images and the images are compared to perform diagnosis. In other words, when the diagnosis based on the image comparison is performed, the dimming control of the image display apparatus 200 and the image display apparatus 300 may be the global dimming control. In this case, the respective backlights of the two image display apparatuses have uniform amounts of light in the entire backlights. The amounts of light are equal in the two image display apparatuses. Therefore, it is possible to perform accurate image comparison.

When the local dimming control is performed and the common dimming control is performed in the two image display apparatuses, amounts of light of the backlights are adjusted to be equal in the two image display apparatuses for each of control regions where amounts of light of the backlights can be independently controlled.

In this embodiment, the image display apparatus 200 and the image display apparatus 300 perform the global dimming control. The common peak signal level determining unit 105 sets highest signal levels among all pixels of respective two image data as peak signal levels of the respective image data. The common peak signal level determining unit 105 determines a higher one of the peak signal levels of the two image data as a common peak signal level (S102). When the image display apparatuses 200 and 300 perform the local dimming control, the common peak signal level determining unit 105 determines highest signal levels among signal levels of pixels in display regions of the liquid crystal panel corresponding to the control regions of the backlights as peak signal levels of the control regions. The common peak signal level determining unit 105 determines a higher one of the peak signal levels of the corresponding control regions of the two image data as a common peak signal level of the control regions. In other words, when the local dimming control is performed, the common peak signal level determining unit 105 determines a common peak signal level for each of the control regions of the backlights. The adjustment of amounts of light of the backlights and the adjustment of the LUT in S204 and S205 are performed for each of the control regions on the basis of the common peak signal level of each of the control regions.

Figure 5:
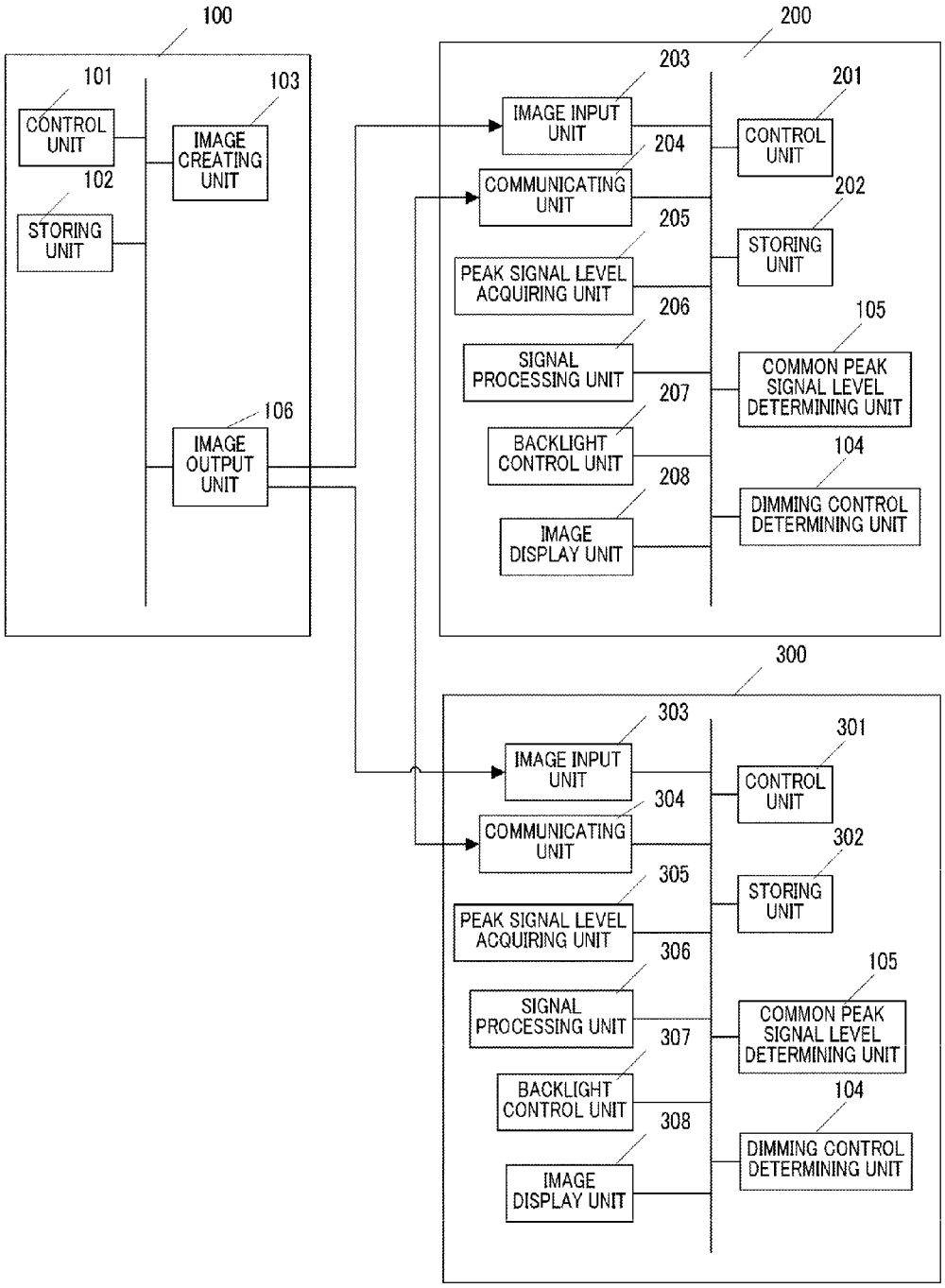
FIG. 5 is a diagram of an example of image display apparatuses according to a modification of the first embodiment.

In the example explained in this embodiment, the PC 100 extracts the common peak signal level. However, as shown in FIG. 5, the image display apparatuses may be configured to include the common peak signal level determining unit 105. In this case, the peak signal level acquiring units of the image display apparatuses extract peak signal levels of image data input to the respective image display apparatuses. One image display apparatus functions as a master apparatus and communicates information on the peak signal levels between the image display apparatuses to determine a common peak signal level. When the image display apparatus 200 functions as the master apparatus, the image display apparatus 200 acquires, from the image display apparatus 300, information on a peak signal level of image data (second image data) input to the image display apparatus 300 acquired by the peak signal level acquiring unit 305 of the image display apparatus 300. The image display apparatus 200 performs comparison of two peak signal levels. The two peak signal levels are the peak signal level of the image data input to the image display apparatus 300 acquired from the image display apparatus 300 and a peak signal level of image data (first image data) input to the image display apparatus 200 itself acquired by the peak signal level acquiring unit 205. The common peak signal level determining unit 105 of the image display apparatus 200 determines the peak signal level having a higher level as a result of the comparison as a common peak signal level and transmits information on the determined common peak signal level to the image display apparatus 300.

As shown in FIG. 5, the image display apparatuses may be configured to include the dimming control determining unit 104. The image display apparatus functioning as a master apparatus may determine whether the common dimming control is performed in the two image display apparatuses. For example, when the image display apparatus 200 functions as the master apparatus, the image display apparatus 200 acquires, from the image display apparatus 300, information on image data input to the image display apparatus 300 by performing communication with the image display apparatus 300. The dimming control determining unit 104 of the image display apparatus 200 determines, according to DICOM tag information and an image analysis, whether the image data input to the image display apparatus 300 and image data input to the image display apparatus 200 are image data of the same modality and the same capturing region. Upon determining that both the image data are image data of the same modality and the same capturing region, the dimming control determining unit 104 of the image display apparatus 200 determines that the common dimming control is performed in the image display apparatus 200 and the image display apparatus 300. The dimming control determining unit 104 notifies the image display apparatus 300 of that. When the image display apparatus 200 includes the common peak signal level determining unit 105, the common peak signal level determining unit 105 notifies the image display apparatus 300 of information on a common peak signal level.

In the example explained in this embodiment, the image display system includes the one PC and the two image display apparatuses. However, the image display system may include a larger number of image display apparatuses. In that case, image display apparatuses that should perform the common dimming control are determined out of a plurality of image display apparatuses according to a method same as S101 in FIG. 3 explained above. When the common peak signal level determining unit 105 and the dimming control determining unit 104 are included in the image display apparatuses, the image display apparatus functioning as a master apparatus acquires information on image data input from the other plurality of image display apparatuses. The image display apparatus determines image display apparatuses that should perform the common dimming control among the plurality of image display apparatuses including the image display apparatus itself. When the image display apparatus itself is included in a plurality of image display apparatuses determined as the image display apparatuses that should perform the common dimming control, the image display apparatus transmits common information to the backlight control unit of the image display apparatus itself and the other image display apparatuses as information for determining light amount control for backlights. When the image display apparatus itself is not included in the plurality of image display apparatuses determined as the image display apparatuses that should perform the common dimming control, the image display apparatus transmits common information to the plurality of image display apparatuses as information for determining light amount control for backlights. The image display apparatuses (slave apparatuses) other than the master apparatus receive the information for determining the light amount control for the backlights from the master image display apparatus via communicating units in order to acquire backlight control information. When the slave apparatuses receive the information for determining the light amount control for the backlights from the master apparatus, the slave apparatuses control amounts of light of the backlights on the basis of the information.

Figure 6:
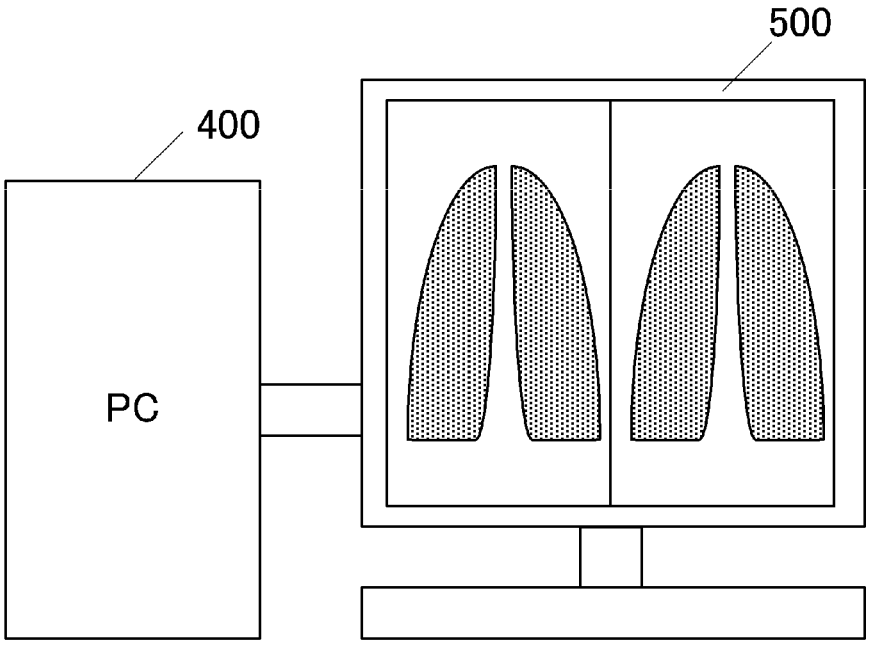
FIG. 6 is a diagram of an example of an image display apparatus according to a modification of the first embodiment.

The present invention can also be applied to an image display apparatus that can display a plurality of images based on a plurality of image data in a plurality of display regions of one image display apparatus 500 as shown in FIG. 6 and can independently control an amount of light for each of control regions of a backlight corresponding to display regions. Regions where images are displayed in one screen are referred to as "windows". In the determination in S101 in this case, the present display window mode is acquired and it is determined whether the common dimming control should be applied to the respective windows. A window mode indicates how many windows are displayed in the screen. FIG. 6 shows an example of a window mode for displaying two windows. However, the number of windows displayed in the screen is not limited to this example. The common dimming control is applied to control regions of backlights corresponding to windows determined as the windows that should be subjected to the common dimming control among a plurality of windows. The independent dimming control is applied to each of control regions of backlights corresponding to the other windows. When each of a plurality of image display apparatuses displays a plurality of images, it is determined for each of the image display apparatuses and for each of windows whether the common dimming control is performed.

Consequently, the common dimming control is applied to image display apparatuses and windows that display different image data of the same modality and the same capturing region. Amounts of light of backlights are the same in the image display apparatuses and the windows. Therefore, it is possible to accurately perform comparison of different images.

Second Embodiment

A second embodiment of the present invention is explained. Differences from the first embodiment are mainly explained. This embodiment is an example in which the present invention is applied to an image display apparatus that can set a part of a display region of an image as a region of interest.

Figure 7A:
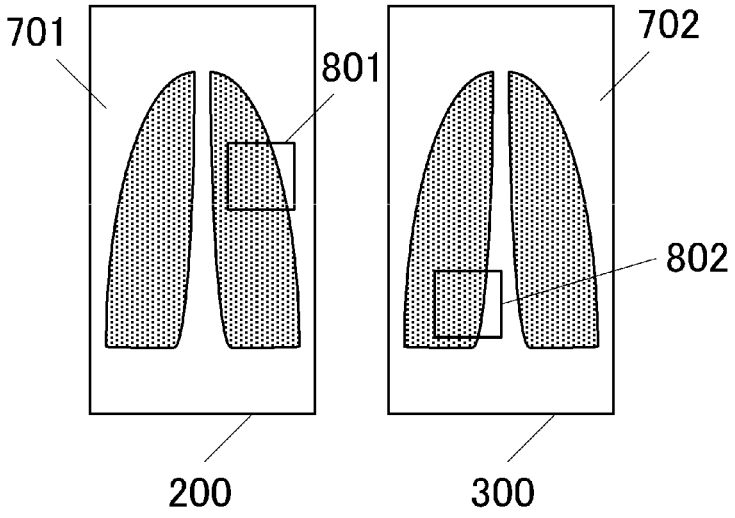
FIG. 7A is an example diagram in which frame lines are rendered in the regions of interest.
Figure 7B:
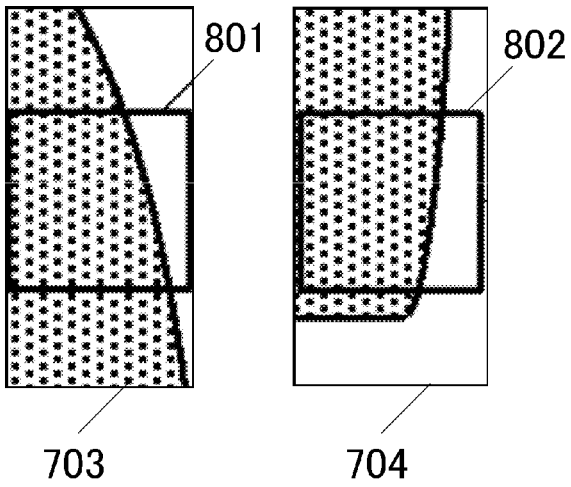
FIG. 7B is an example diagram in which enlarged images of the regions of interest are rendered.

In radiographic image interpretation and diagnosis of a medical image, a part of a region of an image is sometime set as a region of interest as shown in FIG. 7A or designated to be displayed in enlargement as shown in FIG. 7B. In examples shown in FIG. 7A, a region of interest 801 is designated in an image 701 displayed on the image display apparatus 200. A region of interest 802 is designated in an image 702 displayed on the image display apparatus 300. In the example shown in FIG. 7A, frame lines are rendered in the regions of interest. However, as shown in FIG. 7B, it is also conceivable to render images 703 and 704, which are obtained by enlarging the regions of interest, to overlap the images 701 and 702. In the case of a configuration for displaying images based on different image data in a respective plurality of windows in a screen in a window mode, regions of interest are sometimes set in the respective windows.

In this case, in determining in S101 in FIG. 3 whether the common dimming control should be performed, a condition concerning a degree of overlap of regions of interest between image display apparatuses or between windows is added to the condition (whether modalities and capturing regions are the same) explained in the first embodiment. "Regions of interest overlap each other" means that, when display regions of two image display apparatuses are projected on a common coordinate plane, projections of regions of interest set in two display regions have a shared portion.

When the regions of interest do not overlap each other, even if the modalities and the capturing regions of two image data are the same, a user determines that two images and two regions of interest have not been compared and independently perform the dimming control in the two image display apparatuses.

When the regions of interest overlap each other, the user determines that it is highly likely that the two images and the two regions of interest have been compared and performs the common dimming control in the two image display apparatuses. As the determination whether the regions of interest overlap each other, it may be determined that "the regions of interest overlap" if the shared portion is present. Alternatively, for example, an area of the shared portion or a ratio of the area to an area of the regions of interest may be calculated as a degree of overlap and it may be determined that "the regions of interest overlap" when the degree of overlap is equal to or larger than a threshold.

In the examples shown in FIGS. 7A and 7B, the region of interest 801 and the region of interest 802 do not overlap. Therefore, even if the modalities and the capturing regions of the image 701 and the image 702 are the same, it is determined that the independent dimming control should be applied to each of the image display apparatus 200 and the image display apparatus 300.

In the first embodiment, the peak signal level is acquired in S102 or S202 by extracting the highest signal level out of the signal levels of all the pixels of the image data. However, when a region of interest is set, a highest signal level among signal levels of pixels in the region of interest may be set as a peak signal level. In this case, the dimming control for the region of interest may be performed on the basis of the peak signal level. Concerning regions other than the region of interest, the dimming control may be performed using a peak signal level determined by a method same as the method in the first embodiment.

Third Embodiment

A third embodiment of the present invention is explained. Differences from the first embodiment are mainly explained. Detailed explanation is not repeated concerning the same contents. In this embodiment, when it is determined that a plurality of image data satisfy a predetermined condition, a user is inquired whether backlights used for display of the plurality of image data are subjected to the common control such that amounts of light of the backlights are the same. As illustrated in the first embodiment, a condition that, for example, at least any of patient names, modalities, and capturing regions are the same is set as the predetermined condition.

Figure 8:
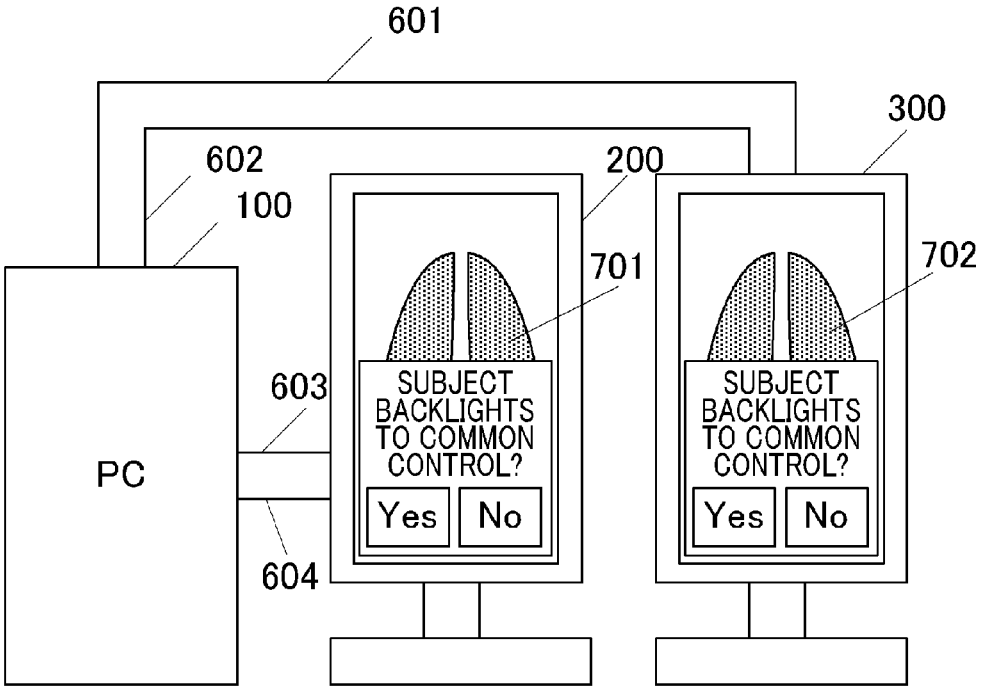
FIG. 8 is a diagram showing an inquiry screen example according to a third embodiment.

FIG. 8 is a diagram showing an inquiry screen example displayed on the image display apparatuses 200 and 300. In this embodiment, in S101 in FIG. 3, the image creating unit 103 shown in FIG. 1 renders a GUI image for inquiring the user whether the backlights are subjected to the common control. The GUI image for inquiring the user whether the backlights are subjected to the common control is output from the image output unit 106 to the image display apparatuses 200 and 300.

When the user replies "YES" on the inquiry screen shown in FIG. 8, the processing proceeds from S101 to S102 and S103 in FIG. 3. Amounts of light of the backlights of the image display apparatuses 200 and 300 are controlled to be the same.

Figure 9:
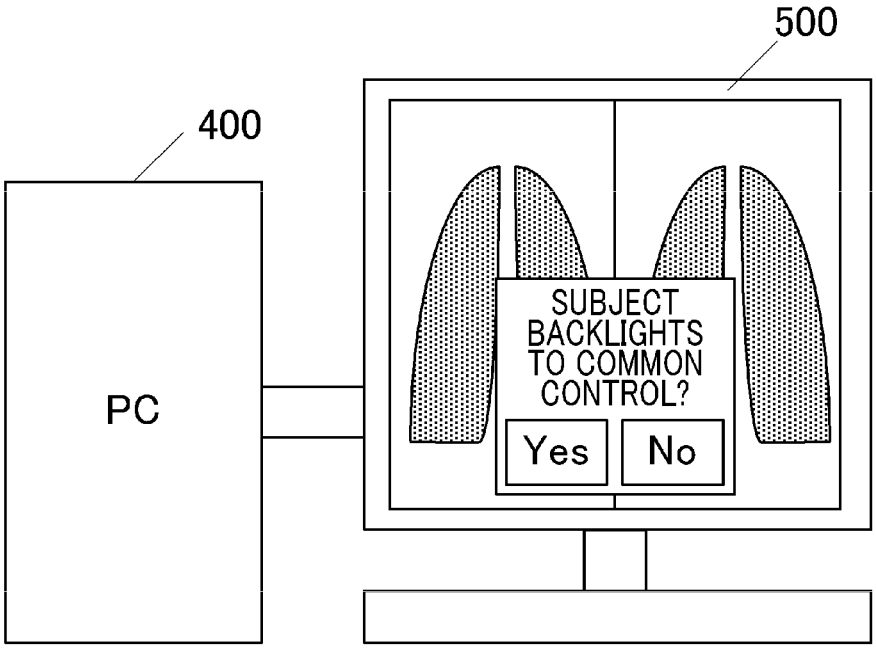
FIG. 9 is a diagram showing an inquiry screen example according to the third embodiment.

FIG. 9 is a diagram showing an example of an inquiry screen displayed on the image display apparatus 500 when a plurality of image data are displayed in a plurality of display regions of one image display apparatus 500. In this case, the image creating unit 103 of the PC 400 renders a GUI image for inquiring the user whether backlights are subjected to the common control. The GUI image for inquiring the user whether the backlights are subjected to the common control is output from the image output unit 106 to the image display apparatus 500.

According to this embodiment, when it is determined that the plurality of image data satisfy the predetermined condition, the user is inquired whether the backlights are subjected to the common control such that amounts of light of the backlights used for display of the plurality of image data are the same. Therefore, convenience for the user is improved.

The contents of this embodiment can also be applied when the image display apparatus functioning as the master apparatus determines whether the common dimming control is performed in the two image display apparatuses as shown in FIG. 5. When the image display apparatus 200 functions as the master apparatus, the control unit 201 of the image display apparatus 200 renders a GUI image for inquiring the user whether the backlights are subjected to the common control. The GUI image for inquiring the user whether the backlights are subjected to the common control is displayed on the image display unit 208.

The contents of this embodiment can also be applied to the second embodiment. The same effects are obtained by the same configuration in the image display apparatus that can set a part of a display region of an image as a region of interest.

Fourth Embodiment

A fourth embodiment of the present invention is explained. Differences from the first embodiment are mainly explained. Detailed explanation is not repeated concerning the same contents. In this embodiment, when it is determined that a plurality of image data satisfy a predetermined condition, backlights used for display of the plurality of image data are subjected to the common control such that both or either of amounts of light and number of light emission control units of the backlights are the same.

Figure 10:
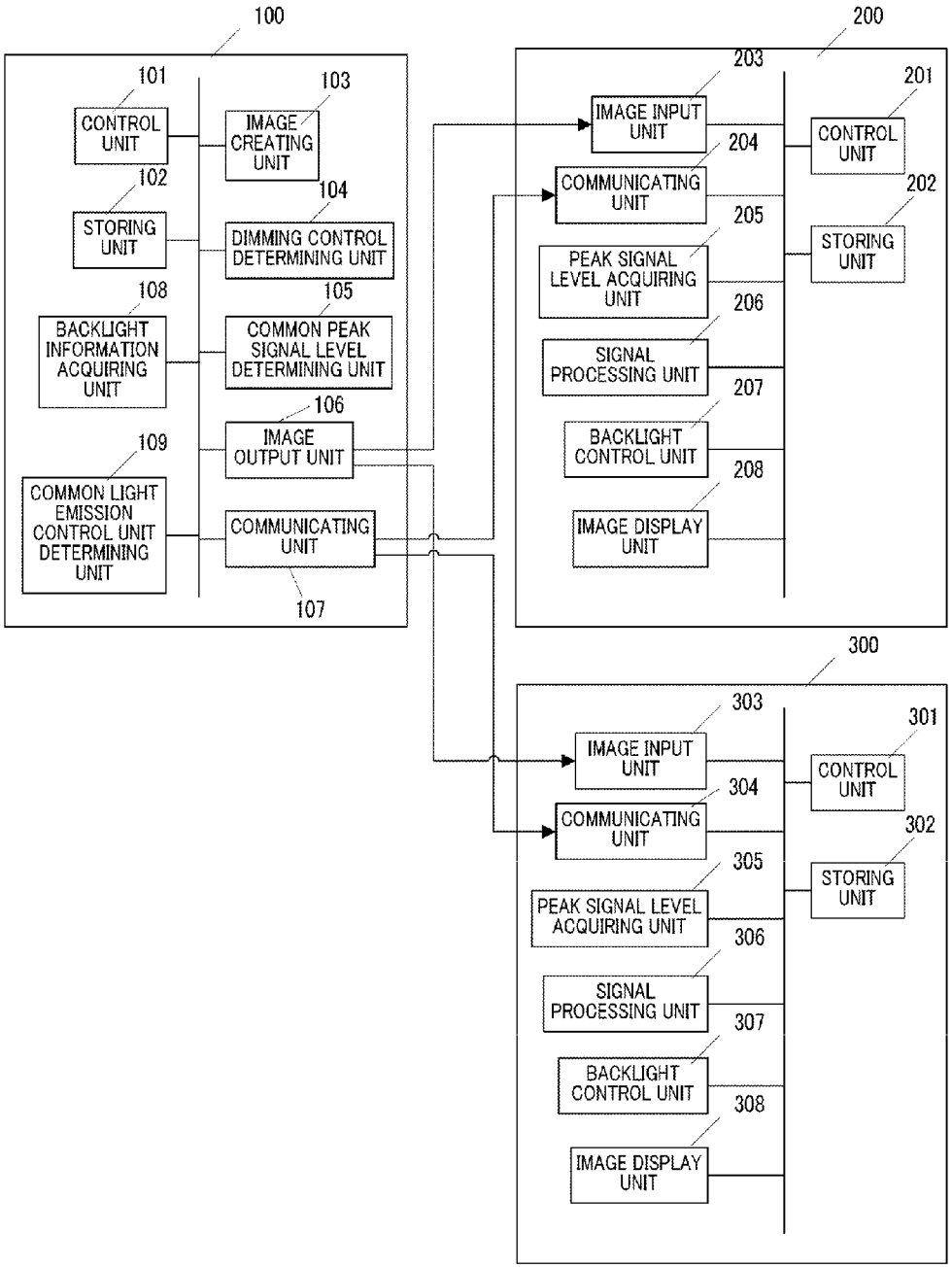
FIG. 10 is a schematic configuration diagram of an image display system according to a fourth embodiment.

FIG. 10 is a schematic configuration diagram of an image display system including the PC 100 and the image display apparatuses 200 and 300 according to the fourth embodiment. The PC 100 includes a backlight information acquiring unit 108, which is second acquiring means for acquiring backlight information of the image display apparatuses 200 and 300, and alight emission control unit determining unit 109 that determines number of light emission control units of the backlights of the image display apparatuses 200 and 300.

Figure 11:
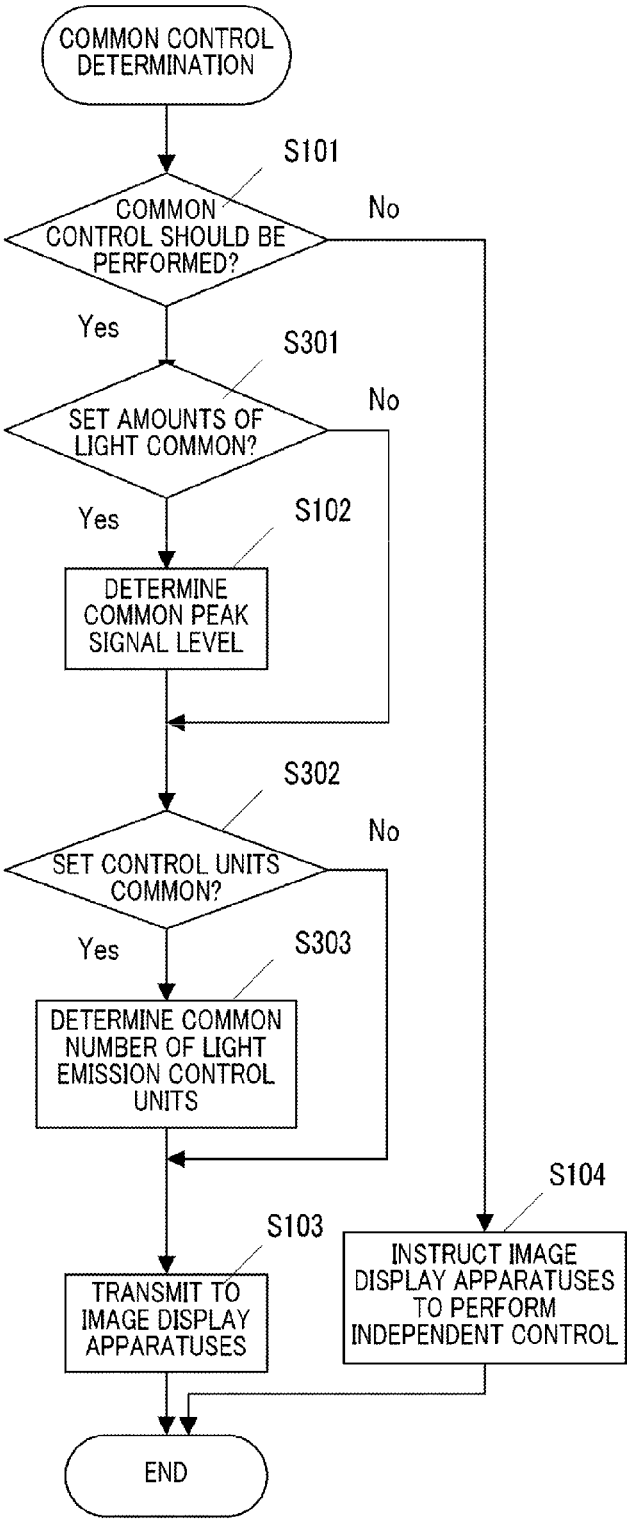
FIG. 11 is a flowchart for explaining the operation of a PC according to the fourth embodiment.

FIG. 11 is a flowchart for explaining the operation of the PC 100 according to the fourth embodiment. In step numbers same as those in FIG. 3, actions same as those shown in FIG. 3 are performed.

When it is determined in S101 in FIG. 11 that a plurality of image data output from the PC 100 to the image display apparatuses 200 and 300 satisfy the predetermined condition (YES in S101), the backlight information acquiring unit 108 acquires backlight information from the storing units 202 and 302 of the image display apparatuses 200 and 300. As illustrated in the first embodiment, a condition that, for example, at least any of patient names, modalities, and capturing regions are the same is set as the predetermined condition. Information on the numbers of light emission control units set in the image display apparatuses 200 and 300 is stored as backlight information in the storing units 202 and 302 of the image display apparatuses 200 and 300. In the global dimming control, the number of light emission control units is one. In the local dimming control, the number of light emission control units is two or more.

Subsequently, in S301, the image creating unit 103 shown in FIG. 10 renders a GUI image for inquiring a user whether the backlights are subjected to the common control. As shown in FIG. 8 in the third embodiment, the GUI image for inquiring the user whether the backlights are subjected to the common control is output from the image output unit 106 to the image display apparatuses 200 and 300. When the user selects "YES" on the inquiry screen shown in FIG. 8, a more detailed inquiry screen is displayed.

FIG. 12 is a diagram showing detailed inquiry screen examples according to the fourth embodiment. FIG. 12A shows a detailed inquiry screen example displayed when number of light emission control units set in the image display apparatuses 200 and 300 are the same. In this case, since number of light emission control units of the backlights are the same, the user is inquired whether amounts of light of the backlights are set common. For example, when the global dimming control is set for both the image display apparatuses 200 and 300 or when the local dimming control with the same number of light emission control units is set, the detailed inquiry screen shown in FIG. 12A is displayed.

FIG. 12B shows a detailed inquiry screen example displayed when number of light emission control units set in the image display apparatuses 200 and 300 are different. In this case, the user is inquired whether number of light emission control units of the backlights are set common or whether amounts of light of the backlight are set common. For example, when the global dimming control is set for one of the image display apparatuses 200 and 300 and the local dimming control is set for the other, the detailed inquiry screen shown in FIG. 12B is displayed. When the local dimming control is set for both the image display apparatuses 200 and 300 but the local dimming control with different numbers of light emission control units is set for the image display apparatuses 200 and 300, the detailed inquiry screen shown in FIG. 12B is displayed.

Steps after S101 in FIG. 11 are executed according to results of replies by the user on the detailed inquiry screens shown in FIGS. 12A and 12B. When the user replies that the amounts of light of the backlights are set common in FIGS. 12A and 12B (YES in S301), the processing proceeds from S301 to S102. Processing for determining a common peak signal level is executed. The processing in S102 is as explained with reference to FIG. 3. On the other hand, when the user replies that the amounts of light of the backlights are not set common (NO in S301), the processing proceeds from S301 to S302.

When the user replies that the number of light emission control units of the backlights are set common in FIG. 12B (YES in S302), the processing proceeds from S302 to S303. Processing for determining a common number of light emission control units is executed. In S303, the light emission control unit determining unit 109 determines number of light emission control units set common in the image display apparatus 200 and the image display apparatus 300. Specifically, the light emission control unit determining unit 109 sets the control units of the backlight of the image display apparatus 200 and the control units of the backlight of the image display apparatus 300 to be the same by using, as a reference, a minimum number of light emission control units among the number of light emission control units of the image display apparatus 200 and the number of light emission control units of the image display apparatus 300.

For example, when the global dimming control is set for one of the image display apparatuses 200 and 300 and the local dimming control is set for the other, the setting of the global dimming control is given priority and the number of light emission control units "1" is set as a reference. The numbers of control units of the backlight of the image display apparatus 200 and the image display apparatus 300 are set to "1". Both of the image display apparatus 200 and the image display apparatus 300 are subjected to the global dimming control.

It is assumed that the local dimming control with the number of light emission control units "8" is set for one of the image display apparatus 200 and the image display apparatus 300 and the local dimming control with the number of light emission control units "4" is set for the other. In this case, the setting of the local dimming control with the number of light emission control units "4" is given priority and the number of light emission control units "4" is set as a reference. The numbers of control units of the backlights of the image display apparatus 200 and the image display apparatus 300 are set to "4". Both of the image display apparatus 200 and the image display apparatus 300 are subjected to the local dimming control with the number of light emission control units "4".

In the above explanation, the number of light emission control units is adjusted to the setting of the image display apparatus having a smaller number of light emission control units. However, when the number of light emission control units of the image display apparatus having the smaller number of light emission control units can be adjusted to the setting of the image display apparatus having a larger number of light emission control units, the number of light emission control units may be adjusted to the setting of the image display apparatus having the larger number of light emission control units.

It is assumed that the control units of the backlights of the image display apparatus 200 and the image display apparatus 300 cannot be set the same. In this case, the control units of the backlights of the image display apparatus 200 and the image display apparatus 300 are set to be the same by using, as a reference, a greatest common divisor of the number of light emission control units of the image display apparatus 200 and the number of light emission control units of the image display apparatus 300. For example, when the local dimming control with the number of light emission control units "3" is set for one of the image display apparatus 200 and the image display apparatus 300 and the local dimming control with the number of light emission control units "2" is set for the other, a greatest common divisor "1" of "2" and "3" is set as a reference. The numbers of control units of the backlights of the image display apparatus 200 and the image display apparatus 300 are set to "1". Both of the image display apparatus 200 and the image display apparatus 300 are subjected to the global dimming control.

When the user replies on the detailed inquiry screen shown in FIG. 12B that the number of light emission control units of the backlights are not set common (NO in S302), the processing proceeds from S302 to S103. In S103, the communicating unit 107 transmits information on the common peak signal level determined in S102 and information on the common number of light emission control units determined in S303 to the image display apparatus 200 and the image display apparatus 300.

According to this embodiment, when it is determined that a plurality of image data satisfy the predetermined condition, it is possible to subject the backlights used for display of the plurality of image data to the common control such that both or either of amounts of light and number of light emission control units of the backlights are the same. Therefore, convenience for the user is improved.

Figure 13:
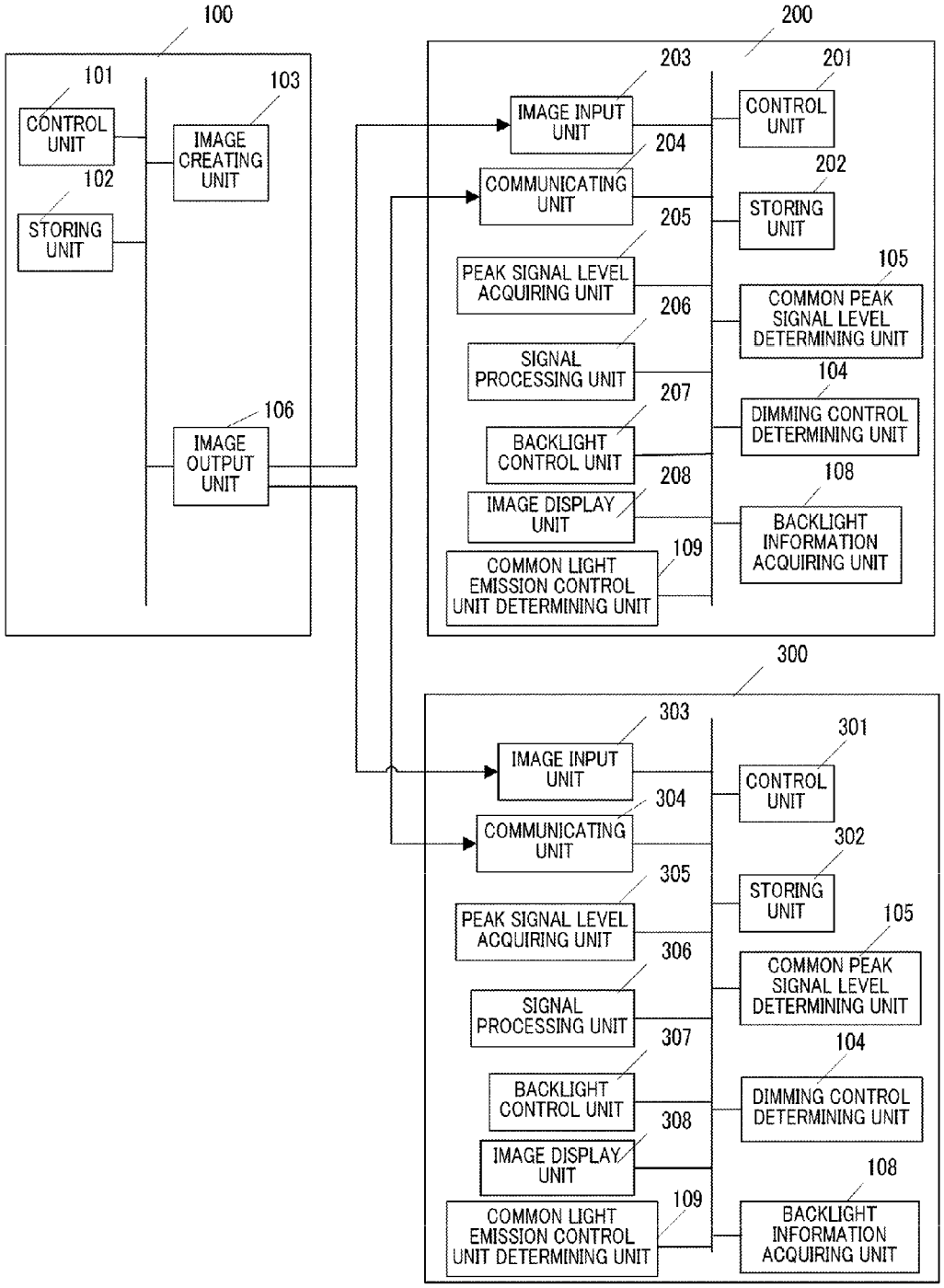
FIG. 13 is an example of image display apparatuses according to a modification of the fourth embodiment.

The contents of this embodiment can also be applied when the image display apparatus functioning as the master apparatus determines whether the common dimming control is performed in the two image display apparatuses as shown in FIG. 5. A schematic configuration diagram of the image display system in this case is shown in FIG. 13. As shown in FIG. 13, each of the image display apparatuses 200 and 300 includes the backlight information acquiring unit 108 that acquires backlight information of the image display apparatuses 200 and 300 and the light emission control unit determining unit 109 that determines number of light emission control units of the backlights of the image display apparatuses 200 and 300.

The contents of this embodiment can also be applied to the second embodiment. The same effects are obtained by the same configuration in the image display apparatus that can set a part of a display region of an image as a region of interest.

Other Embodiments

The present invention can also be realized by executing processing explained below. Software (a computer program) for realizing the functions of the embodiments explained above is supplied to a system or an apparatus via a network or various computer-readable storage media or recording media (nonvolatile memories such as a ROM and a RAM) in which the computer program is stored. A computer (or a CPU, an MPU, etc.) of the system or the apparatus reads out and executes the computer program. Therefore, the computer program itself for realizing the functions of the embodiments is a part of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-267145, filed on Dec. 6, 2011, and Japanese Patent Application No. 2012-191859, filed on Aug. 31, 2012, which are hereby incorporated by reference herein in their entirety.

What is claimed is:

1. An image output apparatus that outputs first image data to a first image display apparatus and second image data to a second image display apparatus, each of the first image display apparatus and the second image display apparatus being capable of controlling amount of light of a backlight thereof, the image output apparatus comprising:

a storage that stores the first image data and the second image data; and a processor configured:

to determine whether the first image data and the second image data stored in the storage satisfy a predetermined condition;

to control, in a case where the first image data and the second image data satisfy the predetermined condition, the first image display apparatus and the second image display apparatus such that the first image display apparatus and the second image display apparatus are the same in amount of light of light emission control of the backlight used for display of the first image data and the second image data by the first image display apparatus and the second image display apparatus even if the first image data and the second image data are different from each other; and to control, in a case where the first image data and the second image data do not satisfy the predetermined condition, the first image display apparatus and the second image display apparatus such that the respective amounts of light of the backlights thereof used for display of the first image data and the second image data by the first image display apparatus and the second image display apparatus are adjusted based on respective signal levels of the first image data and the second image data.

2. The image output apparatus according to claim 1, wherein, in a case where the first image data and the second image data satisfy the predetermined condition, the processor inquires a user whether the first image display apparatus and the second image display apparatus are to be controlled such that the first image display apparatus and the second image display apparatus are the same in the amount of light of the light emission control of the backlight used for the display of the first image data and the second image data by the first image display apparatus and the second image display apparatus and, in a case where the user replies that the first image display apparatus and the second image display apparatus are to be controlled in said manner, the processor controls the first image display apparatus and the second image display apparatus such that the first image display apparatus and the second image display apparatus are the same in the amount of light of the light emission control of the backlight used for the display of the first image data and the second image data by the first image display apparatus and the second image display apparatus.

3. The image output apparatus according to claim 1, wherein, in a case where the first image data and the second image data are the same in at least any of patient names, capturing regions, and modalities thereof, the processor determines that the first image data and the second image data satisfy the predetermined condition.

4. The image output apparatus according to claim 1, wherein each of the first image display apparatus and the second image display apparatus can set a part of a display region of an image as a region of interest, and the processor acquires information on the region of interest from each of the first image display apparatus and the second image display apparatus and, in a case where a degree of overlap of projections of regions of interest obtained as display regions of the first image display apparatus and the second image display apparatus are projected on a common coordinate plane is equal to or larger than a threshold, the processor determines that the first image data and the second image data satisfy the predetermined condition.

5. The image output apparatus according to claim 1, wherein the processor acquires a peak signal level of each of the first image data and the second image data, wherein in a case where the processor determines that the first image data and the second image data satisfy the predetermined condition, the processor sets, as a common peak signal level, a highest peak signal level among peak signal levels of the first image data and the second image data or an average of the peak signal levels of the first image data and the second image data and transmits the common peak signal level to the first image display apparatus and the second image display apparatus as common information for determining amounts of light of the backlights used for the display of the first image data and the second image data by the first image display apparatus and the second image display apparatus.

6. The image output apparatus according to claim 5, wherein, in a case where local dimming control for independently controlling an amount of light of each of a plurality of control regions is possible for each of the first image display apparatus and the second image display apparatus, the processor acquires, for each of the control regions, peak signal levels of the first image data and the second image data, and in a case where the first image data and the second image data satisfy the predetermined condition, the processor sets, for each of the control regions, a highest peak signal level among the peak signal levels of the first image data and the second image data or an average of the peak signal levels of the first image data and the second image data as a common peak signal level, and transmits the common peak signal level for each of the control regions to the first image display apparatus and the second image display apparatus as common information for determining amounts of light of the backlights used for the display of the first image data and the second image data by the first image display apparatus and the second image display apparatus.

7. The image output apparatus according to claim 1, wherein the processor acquires information on the numbers of units of the light emission control of the backlights of the first image display apparatus and the second image display apparatus, wherein in a case where the first image data and the second image data satisfy the predetermined condition, the processor controls the first image display apparatus and the second image display apparatus such that the first image display apparatus and the second image display apparatus are the same in unit of control of the backlight used for the display of the first image data and the second image data by the first image display apparatus and the second image display apparatus by using, as a reference, a minimum number of units of the light emission control among the numbers of units of the light emission control of the first image display apparatus and the second image display apparatus.

8. The image output apparatus according to claim 1, wherein the processor acquires information on the numbers of units of the light emission control of the backlights of the first image display apparatus and the second image display apparatus, wherein in a case where the first image data and the second image data satisfy the predetermined condition, the processor controls the first image display apparatus and the second image display apparatus such that the first image display apparatus and the second image display apparatus are the same in unit of control of the backlight used for the display of the first image data and the second image data by the first image display apparatus and the second image display apparatus by using, as a reference, a greatest common divisor of the numbers of units of the light emission control of the first image display apparatus and the second image display apparatus.

9. An image display apparatus capable of controlling an amount of light of a backlight, the image display apparatus including a processor programmed to function as a device that comprises:

an acquiring unit configured to acquire information on first image data input to the image display apparatus and second image data input to another image display apparatus;

a determining unit configured to determine, on the basis of the information acquired by the acquiring unit, whether the first image data and the second image data satisfy a predetermined condition; and a controlling unit configured:

to control, in a case where the determining unit determines that the first image data and the second image data satisfy the predetermined condition, the image display apparatus and the other image display apparatus such that the image display apparatus and the other image display apparatus are the same in amount of light emission control of the backlight used for display of the first image data and the second image data by the image display apparatus and the other image display apparatus even if the first image data and the second image data are different from each other; and to control, in a case where the determining unit determines that the first image data and the second image data do not satisfy the predetermined condition, the image display apparatus and the other image display apparatus such that the respective amounts of light of the backlights thereof used for display of the first image data and the second image data by the image display apparatus and the other image display apparatus are adjusted based on respective signal levels of the first image data and the second image data.

10. A control method for an image output apparatus that outputs first image data to a first image display apparatus and second image data to a second image display apparatus, respectively, each of the first image display apparatus and the second image display apparatus being capable of controlling amount of light of a backlight thereof, the control method comprising the following steps executed by a processor:

a step of determining whether the first image data and the second image data satisfy a predetermined condition;

a step of controlling, in a case where it is determined in the determining step that the first image data and the second image data satisfy the predetermined condition, the first image display apparatus and the second image display apparatus such that the first image display apparatus and the second image display apparatus are the same in amount of light emission control of the backlight used for display of the first image data and the second image data by the first image display apparatus and the second image display apparatus even if the first image data and the second image data are different from each other; and a step of controlling, in a case where it is determined in the determining step that the first image data and the second image data do not satisfy the predetermined condition, the first image display apparatus and the second image display apparatus such that the respective amounts of light of the backlights thereof used for display of the first image data and the second image data by the first image display apparatus and the second image display apparatus are adjusted based on respective signal levels of the first image data and the second image data.

11. The control method for an image output apparatus according to claim 10, wherein the controlling step includes, in a case where it is determined in the determining step that the first image data and the second image data satisfy the predetermined condition, inquiring of a user whether the first image display apparatus and the second image display apparatus are to be controlled such that the first image display apparatus and the second image display apparatus are the same in the amount of light of light emission control of the backlight used for the display of the first image data and the second image data by the first image display apparatus and the second image display apparatus and, in a case where the user replies that the first image display apparatus and the second image display apparatus are to be controlled in said manner, controlling the first image display apparatus and the second image display apparatus such that the first image display apparatus and the second image display apparatus are the same in the amount of light emission control of the backlight used for the display of the first image data and the second image data by the first image display apparatus and the second image display apparatus.

12. The control method for an image output apparatus according to claim 10, wherein the determining step includes determining that the first image data and the second image data satisfy the predetermined condition in a case where the first image data and the second image data are the same in at least any of patient names, capturing regions, and modalities thereof.

13. The control method for an image output apparatus according to claim 10, wherein each of the first image display apparatus and the second image display apparatus can set a part of a display region of an image as a region of interest, and the determining step includes acquiring information on the region of interest from each of the first image display apparatus and the second image display apparatus and determining that the first image data and the second image data satisfy the predetermined condition in a case where a degree of overlap of projections of regions of interest obtained as display regions of the first image display apparatus and the second image display apparatus are projected on a common coordinate plane is equal to or larger than a threshold.

14. The control method for an image output apparatus according to claim 10, further comprising an acquiring step of acquiring a peak signal level of each of the first image data and the second image data, wherein the controlling step includes setting, in a case where it is determined in the determining step that the first image data and the second image data satisfy the predetermined condition, as a common peak signal level, a highest peak signal level among peak signal levels of the first image data and the second image data or an average of the peak signal levels of the first image data and the second image data and transmitting the common peak signal level to the first image display apparatus and the second image display apparatus as common information for determining amounts of light of the backlights used for the display of the first image data and the second image data by the first image display apparatus and the second image display apparatus.

15. The control method for an image output apparatus according to claim 14, wherein, in a case where local dimming control for independently controlling an amount of light of each of a plurality of control regions is possible for each of the first image display apparatus and the second image display apparatus, the acquiring step includes acquiring, for each of the control regions, peak signal levels of the first image data and the second image data, and the controlling step includes setting, in a case where it is determined in the determining step that the first image data and the second image data satisfy the predetermined condition, for each of the control regions, a highest peak signal level among the peak signal levels of the first image data and the second image data or an average of the peak signal levels of the first image data and the second image data as a common peak signal level, and transmitting the common peak signal level for each of the control regions to the first image display apparatus and the second image display apparatus as common information for determining amounts of light of the backlights used for the display of the first image data and the second image data by the first image display apparatus and the second image display apparatus.

16. The control method for an image output apparatus according to claim 10, further comprising an acquiring step of acquiring information on the numbers of units of the light emission control of the backlights of the first image display apparatus and the second image display apparatus, wherein the controlling step includes controlling, in a case where it is determined in the determining step that the first image data and the second image data satisfy the predetermined condition, the first image display apparatus and the second image display apparatus such that the first image display apparatus and the second image display apparatus are the same in unit of control of the backlight used for the display of the first image data and the second image data by the first image display apparatus and the second image display apparatus by using, as a reference, a minimum number of units of the light emission control among the numbers of units of the light emission control of the first image display apparatus and the second image display apparatus.

17. The control method for an image output apparatus according to claim 10, further comprising an acquiring step of acquiring information on the numbers of units of the light emission control of the backlights of the first image display apparatus and the second image display apparatus, wherein the controlling step includes controlling, in a case where it is determined in the determining step that the first image data and the second image data satisfy the predetermined condition, the first image display apparatus and the second image display apparatus such that the first image display apparatus and the second image display apparatus are the same in unit of control of the backlight used for the display of the first image data and the second image data by the first image display apparatus and the second image display apparatus by using, as a reference, a greatest common divisor of the numbers of units of the light emission control of the first image display apparatus and the second image display apparatus.

18. A control method for an image display apparatus capable of controlling an amount of light of a backlight, the control method comprising the following steps executed by a processor:

a step of acquiring information on first image data input to the image display apparatus and second image data input to another image display apparatus;

a step of determining, on the basis of the information acquired in the acquiring step, whether the first image data and the second image data satisfy a predetermined condition;

a step of controlling, in a case where it is determined in the determining step that the first image data and the second image data satisfy the predetermined condition, the image display apparatus and the other image display apparatus such that the image display apparatus and the other image display apparatus are the same in amount of light of light emission control of the backlight used for display of the first image data and the second image data by the image display apparatus and the other image display apparatus even if the first image data and the second image data are different from each other; and a step of controlling, in a case where it is determined in the determining step that the first image data and the second image data do not satisfy the predetermined condition, the image display apparatus and the other image display apparatus such that the respective amounts of light of the backlights thereof used for display of the first image data and the second image data by the image display apparatus and the other image display apparatus are adjusted based on respective signal levels of the first image data and the second image data.

19. A non-transitory computer-readable storage medium having stored therein a computer program for causing a computer to execute the steps of the control method for an image output apparatus that outputs first image data to a first image display apparatus and second image data to a second image display apparatus, each of the first image display apparatus and the second image display apparatus being capable of controlling amount of light of a backlight thereof, the control method comprising the following steps executed by the computer of the image output apparatus:

a step of determining whether the first image data and the second image data satisfy a predetermined condition;

a step of controlling, in a case where it is determined in the determining step that the first image data and the second image data satisfy the predetermined condition, the first image display apparatus and the second image display apparatus such that the first image display apparatus and the second image display apparatus are the same in amount of light emission control of the backlight used for display of the first image data and the second image data by the first image display apparatus and the second image display apparatus even if the first image data and the second image data are different from each other; and a step of controlling, in a case where it is determined in the determining step that the first image data and the second image data do not satisfy the predetermined condition, the first image display apparatus and the second image display apparatus such that the respective amounts of light of the backlights thereof used for display of the first image data and the second image data by the first image display apparatus and the second image display apparatus are adjusted based on respective signal levels of the first image data and the second image data.

20. A non-transitory computer-readable storage medium having stored therein a computer program for causing a computer to execute the steps of the control method for an image display apparatus capable of controlling an amount of light of a backlight, the control method comprising the following steps executed by the computer of the image display apparatus:

a step of acquiring information on first image data input to the image display apparatus and second image data input to another image display apparatus;

a step of determining, on the basis of the information acquired in the acquiring step, whether the first image data and the second image data satisfy a predetermined condition;

a step of controlling, in a case where it is determined in the determining step that the first image data and the second image data satisfy the predetermined condition, the image display apparatus and the other image display apparatus such that the image display apparatus and the other image display apparatus are the same in amount of light emission control of the backlight used for display of the first image data and the second image data by the image display apparatus and the other image display apparatus even if the first image data and the second image data are different from each other; and a step of controlling, in a case where it is determined in the determining step that the first image data and the second image data do not satisfy the predetermined condition, the image display apparatus and the other image display apparatus such that the respective amounts of light of the backlights thereof used for display of the first image data and the second image data by the image display apparatus and the other image display apparatus are adjusted based on respective signal levels of the first image data and the second image data.

* * * * *